US005568121A

United States Patent [19]

Lamensdorf

[11] Patent Number: 5,568,121

[45] Date of Patent: Oct. 22, 1996

[54] WIRELESS SYSTEM FOR SENSING INFORMATION AT REMOTE LOCATIONS AND COMMUNICATING WITH A MAIN MONITORING CENTER

[76] Inventor: David M. Lamensdorf, 26135 Bella Santa Dr., Valencia, Calif. 91355

[21] Appl. No.: 68,921

[22] Filed: May 27, 1993

[51] Int. Cl.[6] ..... G08B 1/08

[52] U.S. Cl. ..... 340/539; 340/502

[58] Field of Search ..... 340/502, 539, 340/575, 632

[56] References Cited

U.S. PATENT DOCUMENTS

| | | | |
|---|---|---|---|
| 4,331,953 | 5/1982 | Blevins et al. | 340/539 |
| 4,367,458 | 1/1983 | Hackett | 340/539 |
| 4,524,243 | 6/1985 | Shapiro | 340/573 |
| 4,665,385 | 5/1987 | Henderson | 340/539 |
| 4,670,739 | 6/1987 | Kelly, Jr. | 340/539 |
| 4,706,689 | 11/1987 | Man | 340/539 |
| 4,727,359 | 2/1988 | Yuchi et al. | 340/518 |
| 4,866,594 | 9/1989 | David et al. | 364/138 |
| 4,896,277 | 1/1990 | Vercellotti et al. | 364/551.01 |
| 4,916,432 | 4/1990 | Tice et al. | 340/518 |
| 4,980,913 | 12/1990 | Skret | 380/23 |
| 5,056,106 | 10/1991 | Wang et al. | 342/451 |
| 5,134,644 | 7/1992 | Garton et al. | 340/539 |

*Primary Examiner*—Edward L. Coles, Sr.

*Assistant Examiner*—Thomas L. Stoll

*Attorney, Agent, or Firm*—Frank D. Gilliam

[57] ABSTRACT

A system for sensing information at a plurality remote, typically hazardous, locations and transmitting the sensed information to a main monitoring center. Remote portable "attendants" that take the place of a human safety monitor are carried by persons at the remote locations. The portable attendants produce an audible and/or visual warning to the operator at selected times. If the operator does not acknowledge the warning within a selected time, an alarm signal is sounded and is sent to the main central by radio for processing in a central processing unit (CPU). The CPU directs an appropriate safety response and may open a voice radio circuit between central operators and the remote monitor location. A switch is provided so that the remote operator can manually trigger the alarm. A gas sensor which can detect and measure the level of a selected gas may be included at the remote monitor, with the capability of sounding an alarm at the portable attendant and transmitting an alarm signal to the CPU identifying the gas and indicating the level. Sensors for similarly monitoring effectiveness of a ventilation system at the remote location can be provided. Finally, the arrangement for receiving and transmitting radio signals from the central monitor may include a plurality of spaced spread spectrum radio frequency transmitter/receivers to permit the location of the portable remote attendants to be rapidly determined.

8 Claims, 6 Drawing Sheets

+5V
47K
AD0
AD1
AD2
AD3
AD4
AD5
AD6
AD7
ALE
60
58
.1UF
A14
E2
+5VO

LOW-BAT
CPU-FAIL
96
1K
10K
P5.0
P5.1
P5.2
P5.4
GASA
100uf
100pf
100PF
MIC-GND
MIC-IN
N.C.
ACK-PTT/
DAT-VOI/
ALARM/
LOW-BAT/
CPU-FAL/
SPK1
SPK2
GND
BAT-
BAT+
68

WIRELESS SYSTEM FOR SENSING INFORMATION AT REMOTE LOCATIONS AND COMMUNICATING WITH A MAIN MONITORING CENTER

BACKGROUND OF THE INVENTION

This invention relates in general to systems for sensing information at a plurality of remote locations and exchanging the sensed and other information with a central monitor station. More particularly, the invention involves a wireless system in which plural, portable attendants carried by individual operators can monitor their safety, detect the presence of hazardous gases, report the location of the individuals and rapidly provide assistance when needed.

A wide variety of hard-wired systems have been developed for detecting hazardous conditions at spaced locations and reporting the presence of hazards to a central location. Typically, these may be used for detecting the presence of smoke and fire, as in the system described by Tice et al. in U.S. Pat. No. 4,916,432. The condition, e.g. temperature, of refrigerated containers stowed aboard ships and at shipping terminals can be monitored by sensors at the container locations, hard wired to a central location which can sound an alarm if temperatures rise, as described by Vercellotti et al. in U.S. Pat. No. 4,896,277. Where a number of cylinders of hazardous gases are stored in a warehouse, factory or the like, gas detectors may be provided at various locations to detect gas leaks and send an alarm signal through a wire to a central processor in the event of a leak, as described by David et al. in U.S. Pat. No. 4,866,594. Similarly, security systems of the sort described by Skret in U.S. Pat. No. 4,980,913, have a plurality of intrusion detectors wired to a central control station to sound an alarm, notify police, etc., upon detection of an intrusion.

While these systems are effective in fixed locations, such as rooms in a building, they are not portable or adaptable to changing conditions. They are not capable of sensing hazardous conditions involving persons moving from locations to location, such as moving in and out of rooms, tunnels, etc., and generally accomplish a single purpose.

Very specific protective occupational safety and health regulations are in effect governing the entry of persons into confined spaces, areas where hazardous gases may be present and the like. Often, a human attendant must be present outside the space or area, continuously observing the person working in the area. Such attendants are expensive, sometimes are distracted and may not be able to clearly see the working person in narrow spaces, such as curved tunnels. Should the working person be overcome by gases such as carbon monoxide or simply the absence of oxygen, the attendant must summon help, which may take a dangerously long time to arrive.

Thus, there is a continuing need for a portable system for monitoring conditions at remote sites that can sense adverse conditions, warn the user of the danger and sound an alarm at a central location from which help can be immediately dispatched. The system must be portable and compact so that it can be easily carried by workers (or other person operating the system) moving among work sites, e.g. in tunnels, small contiguous compartments and the like. Also needed is a system for determining when a worker is incapacitated or overcome by hazardous conditions. Where the worker is moving about, it is necessary to be able to rapidly determine his position in the event of an emergency.

SUMMARY OF THE INVENTION

It is, therefore, an object of this invention to provide a portable system for sensing information at remote locations and transmitting signals to, and receiving signals from, a central monitoring station relative to various hazardous conditions, the condition of an operator carrying the sensing system and the location of the operator. Another object of this invention is to provide a system capable of interrogating the operator on a regular schedule and sounding an alarm when the operator fails to respond. A further object is to provide a system which is capable of providing both an identification of a hazardous gas at a remote location and the level of gas present.

The above-noted problems are overcome, and objects attained, by the system of this invention, which basically comprises a main monitoring center including a central processing unit and radio communication means and a plurality of independent remote portable units. each including radio means for communicating with the main monitoring center. Each remote portable attendant is carried by an operator working and moving about in possibly hazardous areas and serves as a portable electronic attendant, serving most of the functions of a human attendant. The remote portable attendant does not become bored, distracted or out of sight of the person being monitored, as often happens with a human attendant.

Each remote attendant includes selective timing means for generating an audible and/or visual inquiry signal to an operator carrying or near the remote attendant on a selected time schedule. The remote attendant includes an acknowledgement means permitting the attendant to send an acknowledgment signal to the monitoring center. In the event that no acknowledgement signal is received by the monitoring center within a selected time, an alarm will sound at the monitoring center alerting operators there to investigate, send help, etc. A manual alarm means is also included at the remote attendant, permitting the operator to send an alarm generating signal to the monitoring center in the event of an emergency. Thus, a single main monitoring center can serve as a back-up safety attendant for a large number of operators working in the field, each with a remote portable attendant that is interrogated in seriatim on a regular basis.

Typically, the monitoring center utilizes a central processing unit (CPU) which may be programmed to make the selected interrogations, displaying the identification and location of each remote portable attendants on a screen during the interrogation sequence.

Where the operators carrying the portable attendants are working in areas possibly having a deficiency of oxygen or possibly containing hazardous gases, the portable attendant units will include gas sensors capable of detecting the presence and level of oxygen and the hazardous gases. The sensors include means for sounding an alarm at the portable attendant unit in the event of low oxygen or high hazardous gas levels and of sending a signal to the main monitoring center giving oxygen and other gas levels. The CPU will cause an alarm to sound at the center in the event of hazardous conditions and can cause an audible and/or visual alarm to sound at other remote attendants that are in the general area of the unit detecting the hazardous condition. If desired, remote portable attendants can be left at remote sites while the site is subject to possible hazardous gas conditions, such as buildings temporarily containing gas cylinders, to alert the central station of leaks or the like when a human operator is not present at the remote site. In addition, the remote gas detectors can monitor the efficiency of ventilation systems by monitoring the oxygen levels and the level of oxygen relative to the level of other gases, such as carbon dioxide or carbon monoxide, for example in areas where internal combustion engines are running.

The central monitoring unit also may include means for tracking locations of remote portable attendants as the operators thereof move about. A plurality, typically three, spaced spread spectrum radio frequency transmitter/receivers are operatively connected to the central station receiver and CPU. Signals from individual portable attendants are received by the central receivers at differing times, the combination of receiving times permitting location identification. Each portable attendant can contain means for returning a signal identifying the particular unit and operator upon receipt of an interrogation signal from the main monitoring center.

The remote units can also be left at remote sites where there may be a number of workers coming and going. An arriving worker can log into the central monitoring unit through a local area network based system and log out when leaving.

BRIEF DESCRIPTION OF THE DRAWING

Details of the invention, and of certain preferred embodiments thereof, will be further understood upon reference to the drawing, wherein.

DETAILED DESCRIPTION OF PREFERRED EMBODIMENTS

Figure 1:
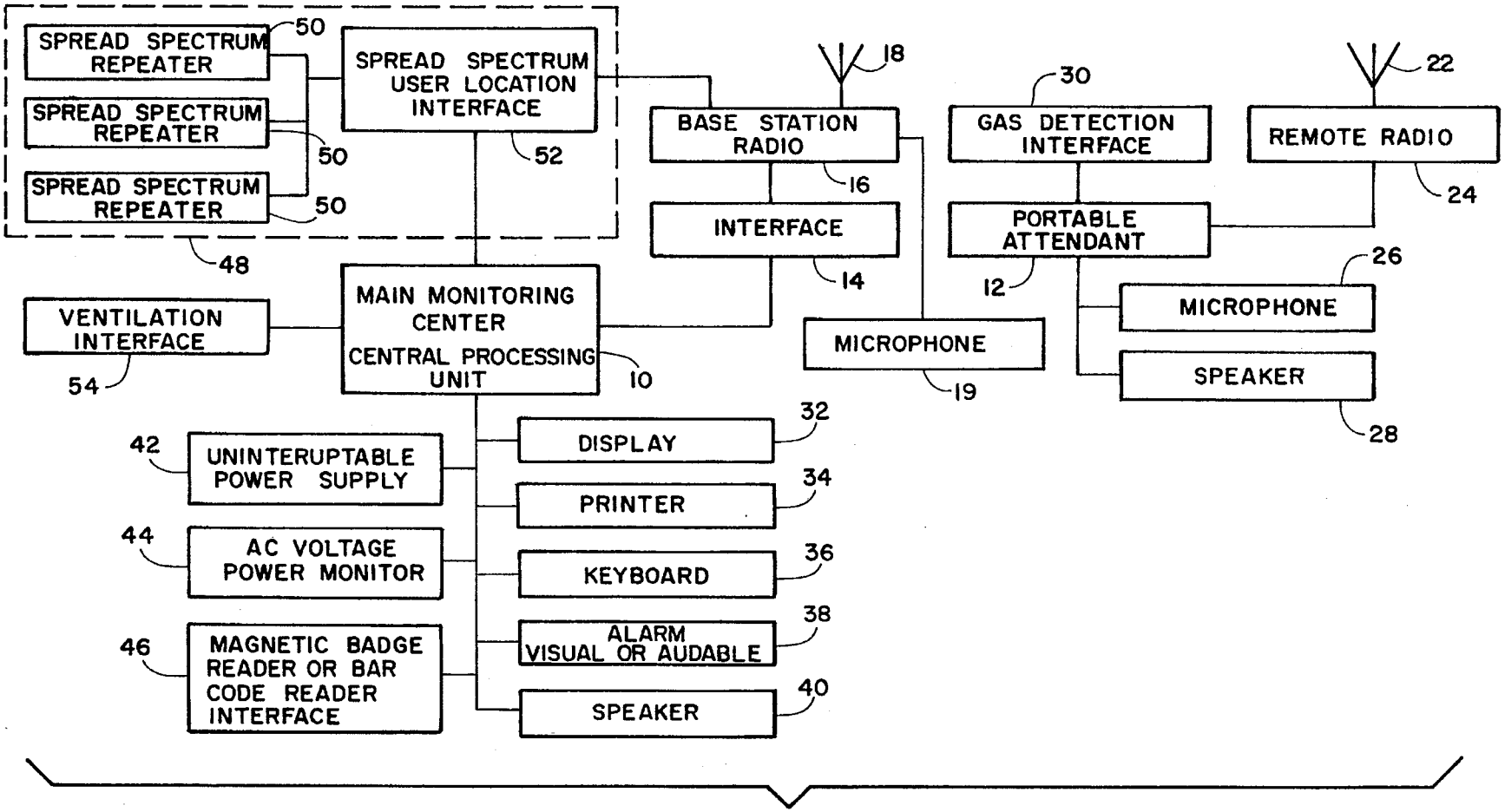
FIG. 1 is a general block diagram of the system and major functional components.

Referring now to FIG. 1, there is seen a block diagram of the overall system of this invention. The main monitoring center 10 includes the central processing unit (CPU) that controls the system. Any conventional computer having the required capacity may be used, such as a 486SX or 486DX, 50 MHz, based computer with an 8 channel analog input, 8 bit data bus, 48 inputs/outputs, 256 byte RAM. Main monitoring center 10 communicates with plural remote portable attendants 12 through a conventional interface or modem 14 and a base station radio 16 through antenna 18. A microphone 20 may be provided at radio 16 for direct audio communication with the operator of the portable attendant 12. Any suitable radio station may be used, such as a Motorola model RNet 450-SLM telemetry radio.

Portable attendant 12 receives signals from main monitoring center 10 through antenna 22 and remote radio transmitter/receiver 24, which may be any suitable radio such as the above-mentioned Motorola radio. Portable attendant 12 is provided with a microphone 26 and speaker 28 for voice communication with main monitoring center 10. The portable attendant 12 includes a CPU generally similar to that at the main monitoring center, except that somewhat lower capacity is required. Typically the CPU may be operated by an 8051 processor running at about 11 MHz.

As detailed below, a gas detection interface 30 may be provided at portable attendant 12 to detect and measure the level of selected gases at the remote site. Where the presence or absence of specific gases is hazardous, an alarm is sounded at both the portable attendant 12 and main monitoring center 10.

Main monitoring center 10 preferably includes a number of accessory components to optimize operation. These may include a display 32 such as a conventional cathode ray tube or liquid crystal display, a printer 34 for making hard copies of displayed information and a keyboard 36 for entering text. An alarm 38 is provided, which may be any suitable combination of visual and/or audible alarms such as alarm horns, flashing lights, etc. A speaker 40 is provided for receiving voice communications from the remote site. For optimum safety, it is preferred that a conventional uninterruptible power supply 42, typically including back up batteries or generator and an AC voltage power monitor 44 be provided. If desired, a magnetic badge reader, bar code reader, or the like 46 may be provided to permit operators to log onto the system (both at the main and remote locations). A conventional PC may be used, incorporating the CPU, display 32 and keyboard 36 and working with a conventional computer printer 34 at either or both of the main center and the portable attendant.

A locator system 48 may be provided to enable the operator of main monitoring center 10 to rapidly and precisely determine the location of the remote portable attendants 12. Radio 16 can operate on a spread radio frequency (RF) spectrum, typically using an approximately 3 Mhz band of the RF spectrum, which provides a maximum data rate of about 122 Kpbs. A plurality of spread spectrum repeaters 50 (typically three) are provided at spaced locations, connected to the main monitoring system 10 and base station radio 16 through an interface 52. By applying the additive summation and difference in the time at which a portable attendant's radio signal to reach each repeater the location of the portable attendant can be precisely determined in a conventional manner.

If desired, a ventilation interface 54 may be provided. The ventilation system at the various work locations such as tunnels, buildings etc. will include a conventional radio controlled "on" over-ride switch under the control of main monitoring center 10. A control signal can be sent to the ventilation system to maintain it in operation whenever a portable attendant 12 is in the ventilated area.

Figure 2:
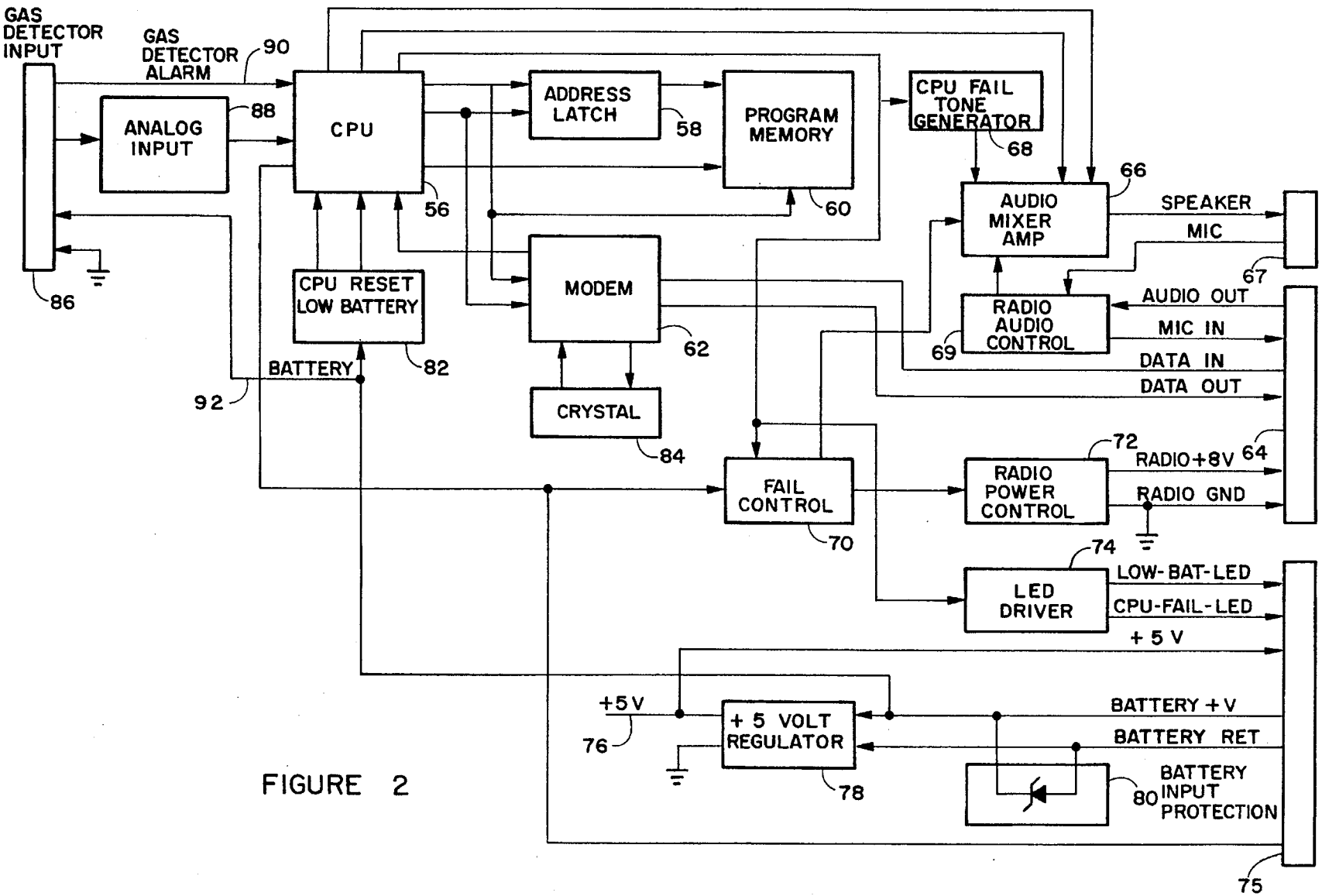
FIG. 2 is a general block diagram of the portable electronic attendant.

The components of a portable attendant 12 are illustrated in the schematic block diagram of FIG. 2. The components of the main monitoring center 10 are basically similar, but with greater capacity and may included added features, as described above. Central processing unit 56 is typically an 8 bit, 256 RAM, CPU such as a Siemans model SAB806535-16N. CPU 56 is connected through address latch 58 (typically a Motorola 74HC573) to program memory 60 (typically a Texas Instruments TMS27C128A-15).

Signals are transmitted to, and received from, the main monitoring center 10 through modem 62, (typically a SSI 73K224L-IP), a radio input/output connector 64. (typically a T&B Ansley DB15S H2R15ST29BS, and a conventional radio (not shown), typically a Motorola RNet 450 telemetry radio. CPU 56 is connected to a conventional microphone and speaker (not shown) through audio mixer amplifier (typically a National LM358) and terminal 68 (typically a Stripline M440-240-100-S20G).

Should CPU 56 fail, a CPU fail tone generator 68 (typically a Motorola 74HC14) will send a selected tone signal to the speaker through audio mixer amplifier 66, alerting the operator to the fact that the portable attendant can no longer be relied on to alert him to hazardous conditions. The failure signal from CPU 56 to fail tone generator 68 also passes to fail control unit 70, an audio mixer, (typically a National LM358) which passes the failure signal both to the radio through radio power control 72 and input/output connector 64 through LED driver 74 (typically a Motorola 74HC157) to a conventional panel of light emitting diode indicators (not shown) through a terminal 74 (typically a Stripline M440-240-100-S 20G). The CPU failure signal entering LED driver 74 may indicate general failure of the CPU or may indicate low battery power. Separate light emitting diodes on a control panel (not shown) on portable attendant 12 will indicate the failure cause.

A conventional rechargeable 10 volt battery (not shown) is connected to the system through terminal 74. The battery is recharged externally via a negative Delta V charger, typically an Axexander Battery NG62000. The battery is connected to CPU 56 through a reset and low battery detector 82 (typically a Dallas DS1231-20).

Modem and CPU 56 frequency is established by a suitable crystal 84, typically a C06050-11.0592 MHz crystal from Raltron.

A conventional gas detector, (not shown) selected in accordance with the gas to be detected, e.g., carbon monoxide, hydrocarbons, oxygen, such as a model Safe-T-Mate Type 400 from Gas Tech is connected to the system through terminal strip 86. An analog input conditioning device 88, (typically a Motorola LM324) transmits the gas sensor signal to CPU 56. Detection of excessive hazardous gas (or insufficient oxygen) is transmitted from the gas sensor via terminal 86 and line 90 to CPU 56, from which an alarm signal is transmitted to a speaker via audio mixer amplifier 66 and terminal 68. The gas sensor is powered by the battery through line 92.

Figure 3:
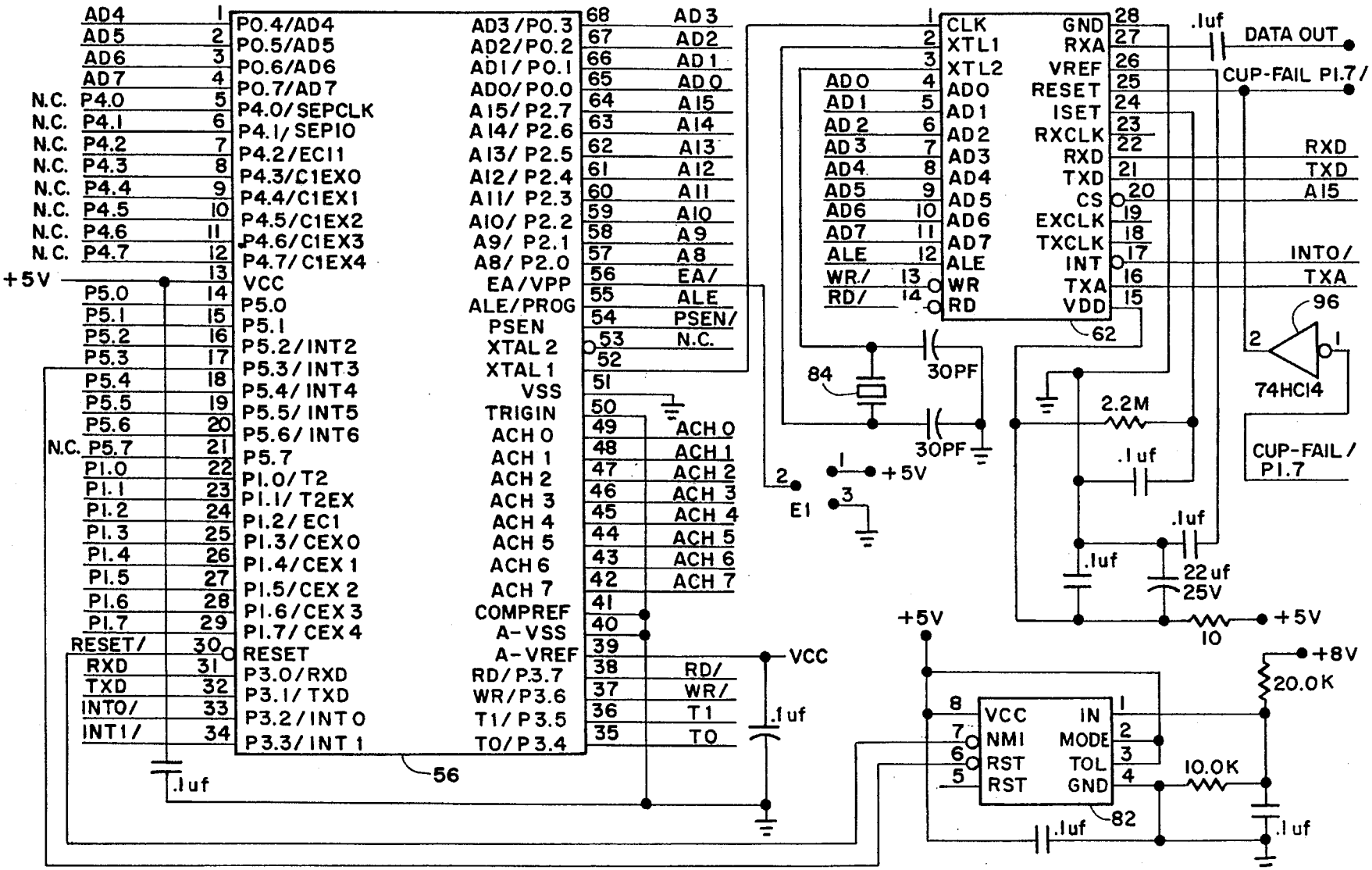
FIG. 3 comprises a schematic circuit diagram of a portion the overall operating circuit relating to the central processing unit and modem.

FIGS. 3–6 provide, in combination, a detailed electrical schematic diagram of the optimum operating circuit. As seen in FIG. 3, the heart of the system is CPU 56 and modem 62. Crystal 84 provides frequency control to modem 62. Low battery detector 82 provides a signal to CPU 56 to sound an appropriate alarm. Capacitors and resistors have the values shown. Any suitable capacitors and resistors may be used. For example, capacitors may be Sprague CK05BX330K or Nichicon NSR22M35V capacitors as appropriate. Suitable resistors are widely available, for example from Bourns or Allen-Bradley.

Figures 4, 7:
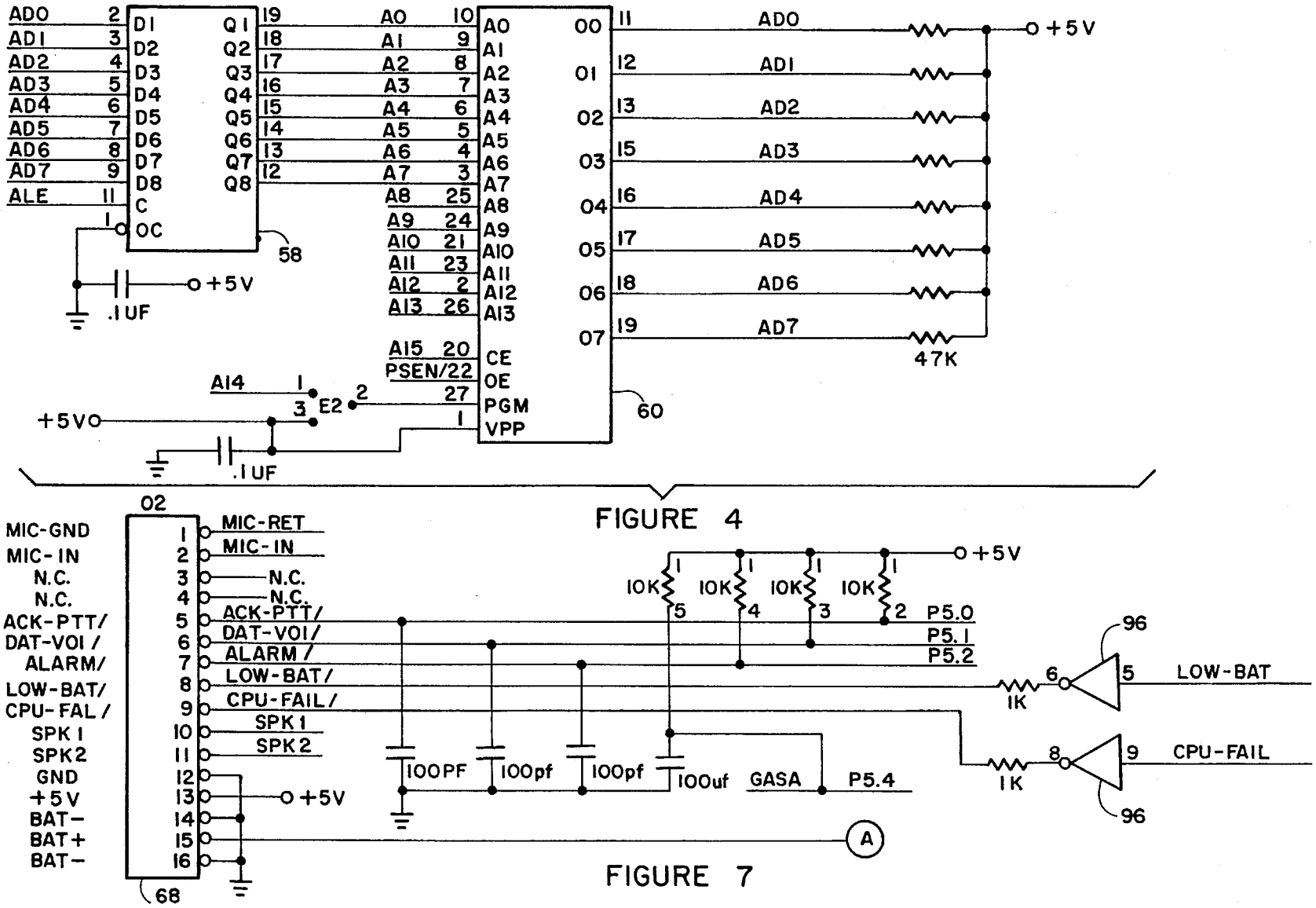
FIG. 4 is a schematic circuit diagram of a portion of the circuit relating to the program memory.
FIG. 7 is a schematic circuit diagram of a portion of the circuit relating to low battery and CPU failure alarms.

FIG. 4 shows the program memory system portion of the circuit including detailed connections to the various pins, based on program memory unit 60 in cooperation with address latch 58, as described above.

Figure 5:
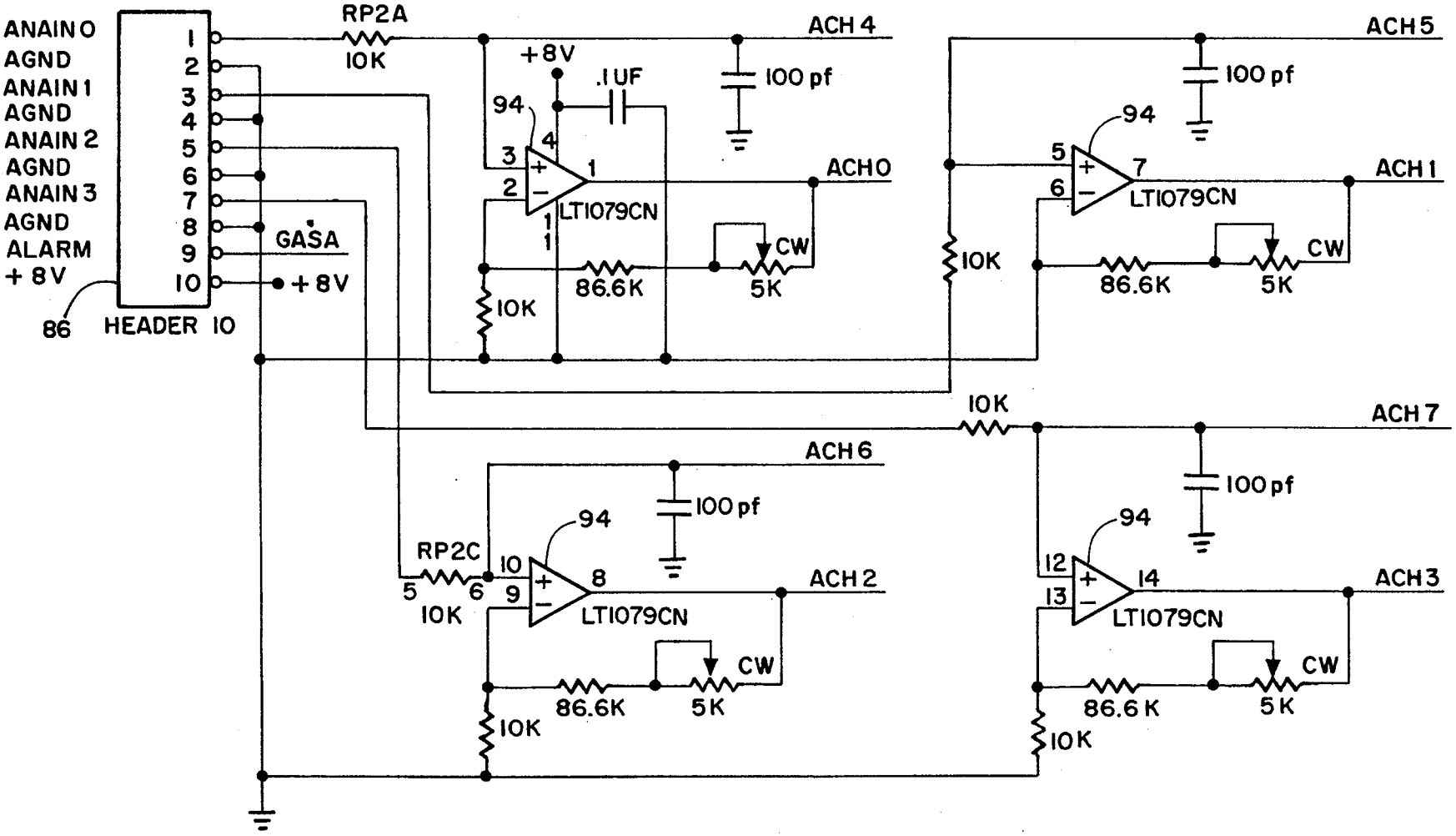
FIG. 5 is a schematic circuit diagram of a portion of the circuit relating to the operational amplifier circuit and associated terminal.

FIG. 5 illustrates in detail the circuit portion making up the gas detection 10 times amplification circuit of FIG. 2. The several LT1079CN units 94 shown make up operational amplifier units of the sort available from Linear Tech under the TL780-05 designation. The several 5K potentiometers shown are typically available from Bournes under the R26JFN502 designation.

Figure 6:
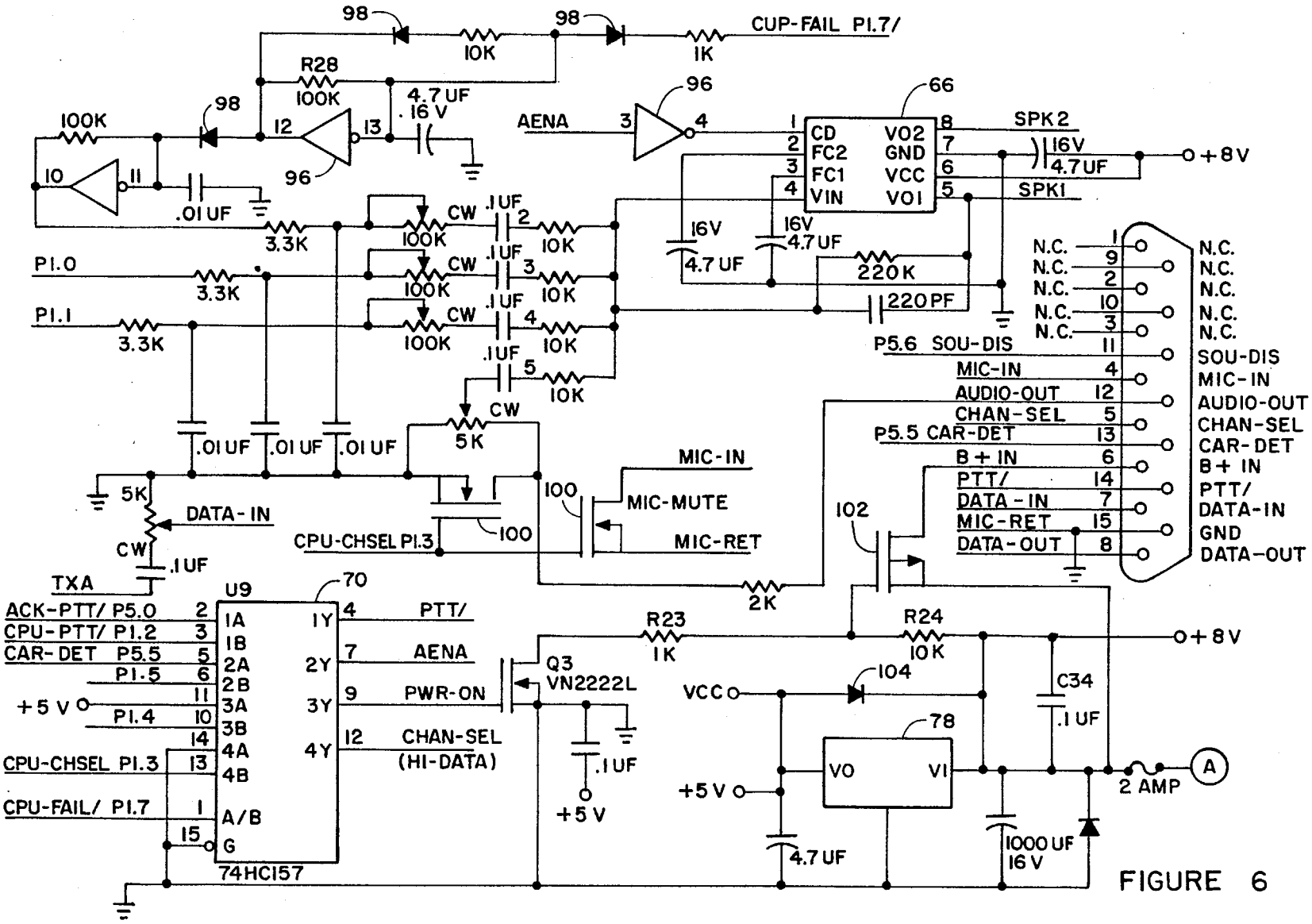
FIG. 6 is a schematic circuit diagram of a portion of the circuit relating to the audio amplifier, multiplexer and radio interconnect circuits.

FIG. 6 shows the portion of the circuit that includes the voltage regulator 78, fail control multiplexer 70 and audio mixer amplifier 66. Amplifier units 96, each a portion of a (typically) Motorola 74HC14, serve as LED drivers and fail tone generators. Light emitting diodes 98 are each typically a 1N6263 from Siliconix. Transistors 100 are each typically a VN2222L field effect transistor from Siliconix. Transistor 102 is typically a MTP8P08 from Motorola. Diode 104 and 106 are typically a 1N4001 and P6KE12, respectively, from Motorola.

FIG. 7 shows a portion of the circuit including operational amplifiers 96 which produce alarm signals for low battery and CPU failure occurrences. These signals pass to terminal 68 and appropriate audio speakers.

The circuit for the main monitoring center is generally the same as that shown in FIGS. 3–7, with the exception of somewhat greater CPU capacity and the inclusion of conventional switching arrangements to permit individual remote portable attendants to be contacted.

The major components of the remote portable attendant function as follows. CPU 56 requests, reads and acts on instructions stored in program memory 60 in a conventional manner, controls traffic by sending signals to address latch 58 and program memory 60 as required and monitors low battery conditioning and reset from low battery detector 82. If a low battery signal is received, CPU 56 forwards the signal to LED driver 74 for display of a visual low battery LED indicator. The clock signal from crystal 84 is used by modem 62 for system timing. Where gas detection is included, CPU 56 monitors analog data from a conventional gas detector via analog conditioner 88 and monitors the gas detector alarm output. In the event of a failure at the CPU, fail signals are sent to CPU fail tone generator 68, the portable attendant fail control 70 and LED driver 74 to produce both an audible and visible indication of failure. Modem 62 also sends information received on the data buss to the CPU, and sends and receives analog encoded data to and from the radio. Audio mixer and amplifier 66 also mixes and amplifies tone out normal and alarm telemetry signals from the CPU and sends audio signals to speakers. Radio audio control 69 also conventionally mutes the microphone signal to the radio during data transfer, enables microphone audio signal to the radio during voice mode operation and enables audio to audio mixer and amplifier 66 during voice mode operation.

When in use by a person, the remote portable attendant checks its user at preset regular time intervals by initiating an audible and/or visual status query, e.g. a sound tone, lighted LED or the like. This query will continue until the user presses the acknowledgement button. Failure of the user to acknowledge the status query within a preset period of time will trigger an alarm warning audible and/or visible, typically a loud tone or flashing light. After a selected period, such as 15 seconds, failure of the user to respond will put the attendant into an alarm state, which will be transmitted to the main monitoring center. Typically, a computer screen at the center will display the user's name and work station as a flashing emergency identifier. The main center operator may then open a voice channel to the user to inquire as to his condition or dispatch a rescue team. Also, the user can press a "help request" button on the portable attendant to manually trigger the alarm. If a gas detection system is installed in or connected to the portable attendant, and hazardous gas conditions are sensed, the alarm will be similarly triggered at the attendant and transmitted to the main monitoring center. The main center can advise other workers in the user's area of the emergency by triggering alarms at their remote personal attendants or sending voice messages to them. If used, the spread spectrum radio system, as described above, can quickly determine the precise location of the attendant generating the alarm at the main monitoring center.

Other applications, variations and ramifications of this invention will occur to those skilled in the art upon reading this disclosure. Those are intended to be included within the scope of this invention, as defined in the appended claims.

I claim:

1. A system for sensing information at remote, potentially hazardous, locations and transmitting sensed information to a central location which comprises:

a main monitoring center including radio means for transmitting signals to, and receiving signals from, at least one remote portable electronic attendant;

at least one remote portable attendant including radio means for receiving information containing signals from, and transmitting information containing signals to, said main monitoring center;

means at said remote portable attendant independent of said main monitoring center for periodically producing an audible and/or visual warning at said remote portable attendant on a selected schedule independent from any other remote portable attendant on the system;

manual acknowledgement means at said remote portable attendant for sending an acknowledgement signal to said main monitoring center; and automatic means for generating an alarm signal at a remote portable attendant and for sending an alarm signal to said main monitoring center if acknowledgement is not completed within a selected period.

2. The system according to claim 1 further including means for detecting the presence and concentration of at least one selected gas at said remote portable attendant, means at said remote portable attendant for sending a radio alarm signal and a signal indicative of the gas concentration to said main monitoring center when said concentration exceeds predetermined limits and means for activating an audio and/or visual alarm at said remote portable attendant when said concentration exceeds predetermined limits.

3. The system according to claim 1 further including voice communication means between said remote portable attendant and said main monitoring center.

4. The system according to claim 1 further including means for transmitting and receiving signals at said main monitoring center indicating the location of a remote portable attendant comprising:

a plurality of spaced spread spectrum radio frequency transmitter/receivers connected to said main monitoring center;

means for receiving a signal from a remote portable attendant at said plural transmitter/receivers and for determining the location of that remote portable attendant in accordance with the difference in time said signal from said remote portable attendant is received at each transmitter/receiver.

5. The system according to claim 1 further including display means at said main monitoring center for displaying indicia relating to signals received from said remote portable attendants.

6. The system according to claim 1 further including means at each of said remote portable attendants for manually generating an alarm signal and transmitting said signal to said main monitoring center.

7. The system according to claim 1 further including means at each remote portable attendant for generating an audible and/or visible alarm at a remote portable attendant and transmitting an alarm signal to said main monitoring center in the event of failure of that remote portable attendant central processing unit.

8. The system according to claim 2 further including means for visually displaying information at the main monitoring station relating to any of said remote portable attendants including location of a remote portable attendant and the concentration of a selected gas at that location.

* * * * *